United States Patent [19]

Gibson

[11] 4,108,405

[45] Aug. 22, 1978

[54] LIGHT ASSEMBLY AND FLASHER CIRCUIT

[76] Inventor: Preston H. Gibson, 226 Debbie Ann Ct., Auburndale, Fla. 33823

[21] Appl. No.: 809,115

[22] Filed: Jun. 22, 1977

[51] Int. Cl.[2] ..... B61L 23/08

[52] U.S. Cl. ..... 246/125; 40/455; 340/47; 350/97; 362/235; 40/902

[58] Field of Search ..... 246/125, 111, 260, 292, 246/293, 294, 473 R, 483 A, 477, 479, 483, 484, 485; 40/132 R, 52; 340/47, 49, 121, 41 A; 350/97, 99, 105, 103; 362/235, 317

[56] References Cited

U.S. PATENT DOCUMENTS

| | | | |
|---|---|---|---|
| 1,252,758 | 1/1918 | Williams | 340/49 |
| 2,488,313 | 11/1949 | Miskelly | 246/125 |
| 2,941,185 | 6/1960 | Mullikin | 340/41 A |

*Primary Examiner*—Trygve M. Blix
*Assistant Examiner*—Reinhard J. Eisenzopf
*Attorney, Agent, or Firm*—George B. Oujevolk

[57] ABSTRACT

Generally speaking the present invention contemplates a kit-type railroad crossing signal device having four red, double lens lights attached to prewired arms, a module for flasher control, a battery box, an automatic controlled battery charger, switching control and, a metal conduit and clamps. A standard railroad signal bell can also be supplied.

3 Claims, 8 Drawing Figures

LIGHT ASSEMBLY AND FLASHER CIRCUIT

BACKGROUND OF THE INVENTION

The present invention relates to railroad crossing signals and more particularly to a temporary or moveable railroad crossing traffic signal.

BRIEF REVIEW OF THE PRIOR ART

Temporary traffic signals are known in the art as shown by my previous patent No. 4,032,883 issued June 28, 1977 and other devices such as:

P. L. B. Lange, U.S. Pat. No. 2,401,940
T. Terrill, U.S. Pat. No. 2,829,362
W. N. DeWald, U.S. Pat. No. 2,838,744
W. J. Mullikin, U.S. Pat. No. 2,941,185
E. G. Cantwell et al, U.S. Pat. No. 3,046,521

The aforementioned prior art relate to street crossing devices. Railroad crossing devices, however, have problems not found in street crossing devices. Street crossing signals are usually placed at busy intersections where there are many facilities available such as near schools, hospitals, etc., all having power lines in the vicinity. Railroad crossing devices are often on some highway quite remote from towns and often, the only power available is that alongside the railroad. It is important that the crossing device does not interfere with the communications for the railroad such as the walkie-talkie devices used between the trainmen and the engineer. Quite often, several crossing signals are heeded where the railroad will cross several roads which are nearby or divided highways.

OBJECTS OF THE INVENTION

Thus, it is an object of the present invention to provide a temporary railroad crossing signal which is independent of the railroad power.

Another object of the present invention is to provide a railroad crossing signal which is portable and can be readily installed.

Still another object of the present invention is to provide a railroad crossing signal which can be carried about on the train.

SUMMARY OF THE INVENTION

Generally speaking the present invention contemplates a kit-type railroad crossing signal device having four red, double lens lights attached to prewired arms, a module for flasher control, a battery box, an automatic controlled battery charger, switching control and, a metal conduit and clamps. A standard railroad signal bell can also be supplied.

The invention as well as other objects and advantages thereof will be more readily apparent from the following detailed description when taken together with the accompanying drawing, in which:

FIG. **6*a*** is a schematic drawing of an additional timer circuit;

FIG. **6*b*** is a schematic diagram of a strobe circuit; and

Figure 7:
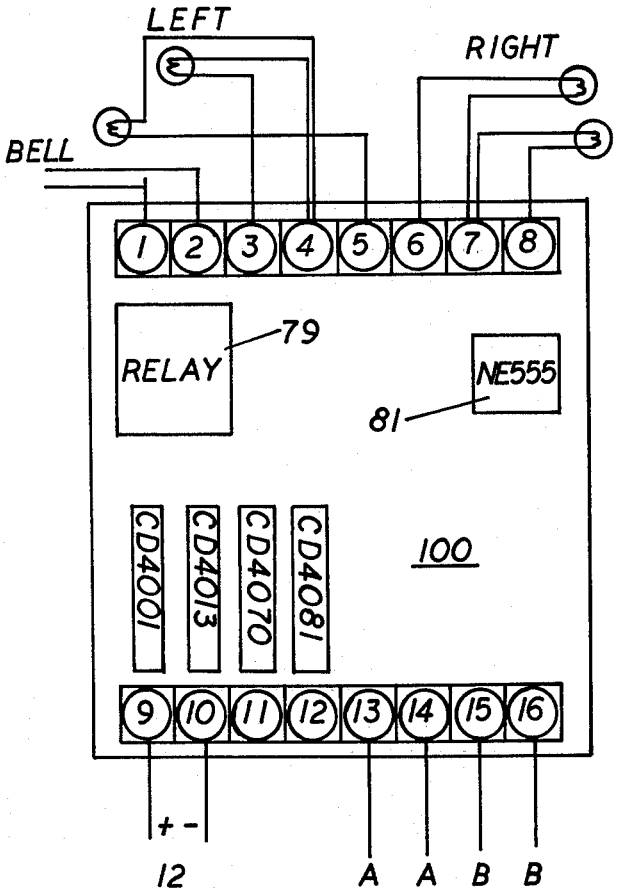

FIG. 7 is a diagram of a plug-in board.

DETAILED EXPLANATION

Shown in the drawing is a railroad crossing signal light system 11. The signal system has tow pairs of red lamps **13*a* and 13*b*, held on the arms of a T-shaped structure 15. The lamps 13*a* and 13*b* are operated by a flasher circuit 17 which in turn are connected to a battery compartment 19. In practice each set of flasher lamps is independently controlled. There are two lamp assemblies per post and preferably at least one post will have a railroad crossing bell 21. In practice it is possible to use EXXON solar batteries 20**.

Each lamp consists of a lens housing 23 and a bulb holder 25. The lens housing is heavy duty fiber glass and holds two red lens 27. The bulb holders 25 hold two 50 candle power bulbs 29. All conduits are heavy duty cast iron and the battery compartment is heavy duty aluminum with security features to prevent the theft of the battery 31 and associated charger 33. The system also includes a plug-in module in the event that electric is locally available. To attract attention a strobe flashing red light 22 can be added in the center of the two flashers. The reason for this additional warning device is to draw attention of the motorist to the signals. In many accidents at railroad crossings, the lights are flashing but the slow rythm of the standard signals doesn't have enough "shock" result to command attention. The strobe flasher would prove valuable to provide more attention getting and consequently would avoid serious accidents. The strobe light 22 is a Xenon flash tube with red lens operated by a transformer 24.

Figure 3:
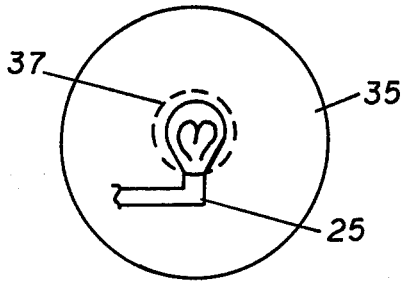
FIG. 3 shows a side view of one of the bulbs with the other bulb out.

Of importance is the construction of the reflector shield 35 between the two bulbs 25. Between the two bulbs 27 is an aperture 37 shown in FIG. 3. Thus if one bulb of the two is extinguished, the other bulb wil provide light through this aperture 37.

To insure good and fail-safe performance each post has a standard hood 39 disposed around the lamp assembly and a shield 41 around the lamp assembly. However, the lens is a 7 inch red lens which provides more candle power than those currently in use. The battery compartment 19 is a heavy gauge cabinet with the special security features mentioned and the system 11 includes a metal conduit post 43. The aperture 37 between bulbs is about $1\frac{3}{4}$ inch diameter.

Furthermore, each lamp has an individual circuit so that if one circuit breaks down the bulb on the other side of the aperture will be visible. Each post also has its own power supply and isolated circuits so that a battery can continue full operation for several days after a power failure. The circuitry is furthermore protected from lightning and other outside interference.

The circuitry is all solid state and consists basically of three modules: the input filter 45, the logic 47 and the timer 49.

Figure 4:
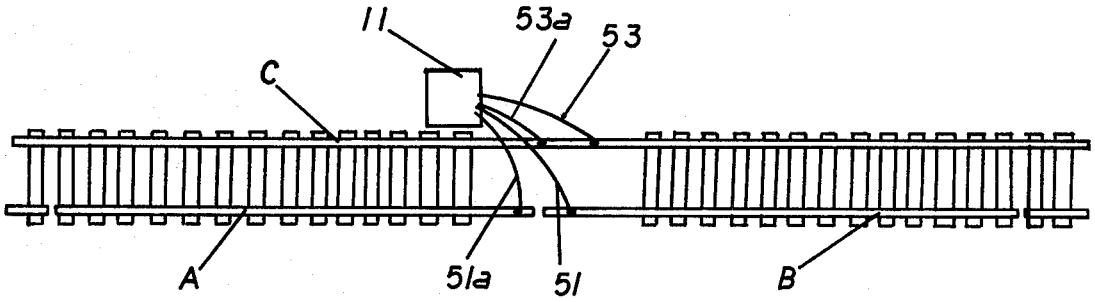
FIG. 4 is an explanation of how the unit is coupled to rails.
Figure 5:
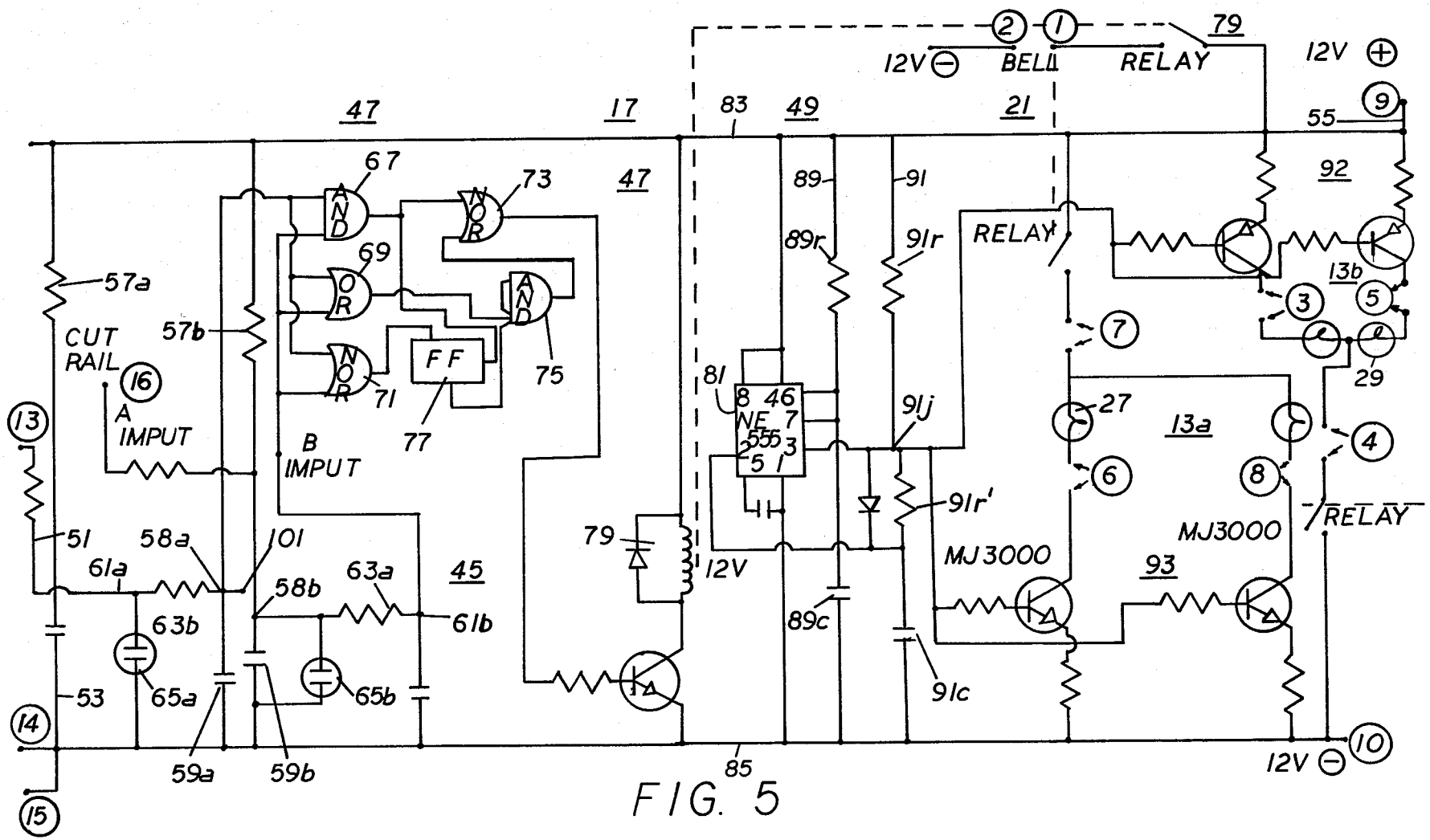
FIG. 5 is a schematic explanation of the electrical circuit.
Figure 6A:
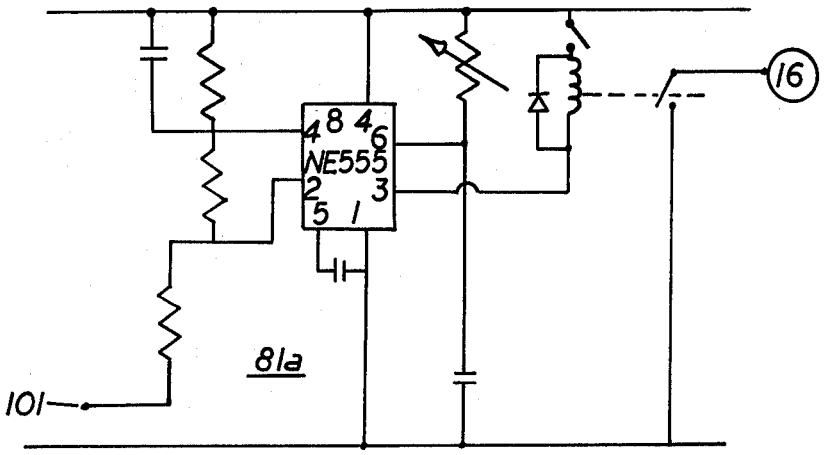
Figure 6B:
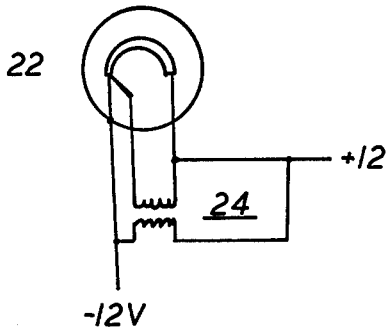

In any railroad system there are two types of rail lines, one line has insulated or cut rails where one rail A does not connect to the next rail B. In the other line all rails are electrically connected, i.e., all rails C are common. There are at least two units at each crossing, one on each side of the tracks. However, in FIG. 4, only one unit is shown.

Each unit 11 has two pairs of pigtails 51, **51*a* and 53, 53*a***, each pair is connected to one side and the other side of the unit but each pair has one line going to the near rail and one line to the far rail. The far side of these pairs going to the cut or insulated rails are designated as points A and B in the schematic diagrams. The near side goes to the joined common or uncut rail C.

A power and a filter circuit 45 is coupled between the two pairs of pigtails, i.e., between pair 51, 51*a* and 53, 53*a*. This power supply and filter circuit has a feed line 55 fed by a battery, a "cut" and an "uncut" feed line each with a 1 kilo-ohm resistor 57*a*, 57*b* and a junction 58*a*, 58*b* and a 100 mf capacitor 59*a*, 59*b*. From the junction 58*a*, 58*b* a line 61*a*, 61*b* extends to points A and B. This line has a 10 ohm power resistor 63*a*, 63*b*. The near side pigtail lines 51, 53 form a common line to the capacitors 59*a*, 59*b*. A neon bulb 65*a*, 65*b* acts as a good and fail-safe indicator between the pigtail lines 51, 53 and the 10 ohm power resistors 63*a*, 63*b*.

The output from the power filter circuit is to the logic circuit 47 as an input to an AND gate 67, an EXCLUSIVE OR gate 69 and a NOR gate 71. The output of the AND gate 67 is one input to a second NOR gate 73; the output of the EXCLUSIVE NOR gate 67 is one input to a second AND gate 75 and the output of the NOR gate 71 is to a flip-flop 77 with a SET and RESET sides. The reset side of the flip-flop 77 is enabled by AND gate 67. The output of the flip-flop is to the second AND gate 75 and the output of second AND gate 75 is to the second NOR gate 73. Second NOR gate 73 provides the input to the timer circuit 49.

One line (plus) from the battery is to feed line 55. Another line (minus) is to the timer circuit across a relay 79 enabled by the logic circuit output.

Preferably, two individual timer circuits are enabled from the logic circuit so that is one breaks down the other still operates. The logic output NOR gate 73 controls a relay 79 of the power line which feeds a 555 timer module 81 which is an 8-pin chip. This module 81 is in parallel across a first and second lines 83, 85. In parallel with module 81 is a capacitor and a timer line 89 having a timing resistor and capacitor 89*r* and 89*c* connected to two pins of the module. In parallel with line 89 is a second line 91 with double the resistor value of line 89 having two resistors 91*r* and 91*r*[1] with a junction 91*j* connected to the timer module 81. Line 91 also has a timer capacitor 91*c*. Resistor 91*r* is shunted by a diode 91*d*. Junction 91*j* is connected to the base of two darlington transistor assemblies 92 and 93, one being PNP the other NPN. Each transistor enables one of the bulbs 27 and 29 shown in FIGS. 1 and 2. Each transistor assembly 92 and 93 has proper bias and load resistors which have not been numbered. The timer is used as a ½second astable oscillator with a 50/50% duty cycle. The output high feeds one darlington connected NPN power transistor lighting bulb 27 for ½ second. The output low feeds the other darlington connected PNP power transistor. The synchronizing of other lamp circuit is achieved by cross-coupling to pin 2 on the timer across diode 91*d*.

The "truth tables" for the logic circuit are as follows:

TRUTH TABLES

| A | B | Output AND gate | Output OR gate | Output NOR gate | Output flip-flop | Output 2nd AND gate | Output to relay |
|---|---|---|---|---|---|---|---|
| Train approaching from left: | | | | | | | |
| 1 | 1 | 1 | 0 | 0 | 0 | 0 | 0 |
| | 1 | 0 | 1 | 0 | 0 | 0 | 1 |
| 0 | 0 | 0 | 0 | 1 | 1 | 0 | 1 |
| 1 | 0 | 0 | 1 | 0 | 1 | 1 | 0 |
| 1 | 1 | 1 | 0 | 0 | 0 | 0 | 0 |
| Train approaching from right: | | | | | | | |
| 1 | 1 | 1 | 0 | 0 | 0 | 0 | 0 |
| 1 | 0 | 0 | 1 | 0 | 0 | 0 | 1 |
| 0 | 0 | 0 | 0 | 1 | 1 | 0 | 1 |
| 0 | 1 | 0 | 1 | 0 | 1 | 1 | 0 |
| 1 | 1 | 1 | 0 | 0 | 0 | 0 | 0 |

The final output is fed to relay 79 and is used to energize the lamp circuit. The lamps flash during the conditions shown by brackets in the column labelled "Output to relay" only.

It is to be observed, therefore, that the Kit consists of four red, seven inch, double lens lights attached to prewired arms, a module for flasher control, a battery box which contains a service free 70 amp/hour battery, an automatic controlled battery charger, a thermostatically controlled heater, switching control and spare bulbs and lens. Metal conduit and clamps are included. A standard railroad signal bell is furnished for one post.

Each Kit can be installed on the existing posts on each side of the tracks identical to standard installations (see instructions).

The local power companies usually install commercial power from up to two miles of wire at no cost.

The system is fully automatic with solid-state circuitry. It is very reliable, requires very little maintenance, simple in design, easily installed, all electrical parts are standard and easily purchased, designed to give years of dependable service, can be removed and transferred to other railroad crossings with little time and expense.

The lights have a hood and shield and separate lamps for each side which gives four flashing lights in both directions, just as standard signals. Each side of each post has independent circuitry as a safety feature and each post is independently powered as an added safety precaution. The batteries will continue to operate the entire system for at least 10 days in case of commercial power failures.

This is designed to provide many dangerous rural crossings with sufficient warnings that will normally be without lighted warnings for many years because of the extremely high cost of standard installations.

This is not to compete with standard installations, but only to provide signals to save human lives and serious injury including property damages and possible lawsuits, in those dangerous crossings thst have no signals and would not have signals for years to come. This is understandable because of the extreme cost. But the extreme cost of not having signals is the lives of many people.

The cost to install this complete kit is less than 1/10th the cost of standard installations. Yet, it operates and looks, outwardly, identical to standard installations. But one important advantage is that the kit can be transferred easily to other crossings if desired.

The average lamp life is 300 hours. This bulb will average 300 days of operation based on one hour per day (12 trains at 5 minutes each).

The lights are considerably brighter to compensate for low visibility due to fog, haze, rain, bright sun, smoke, smog or snow. The flashers are timed approximately as standard signals.

In practice a 12 volt signal is applied to the rails and when a train passes over the rails the signal is shorted out. The logic interrogates the signal sequence and keeps the lamps flashing until the train is clear of the crossing. A capacitor is used to store energy to provide a low impedence feed to the rails simulating a high current source that is actually used.

If two or more crossings are situated within 1600 feet of each other, a means of switching a sound signal to show approach of a train is needed. A variable delay timer 81*a* is actuated when the train crosses the first rail and after a predetermined delay applies a short across the proper rail. The second unit begins flashing, since it has recognized the short as a train approaching. The delay timer 81*a* enables a second relay 79*a* coupled to the input 61*a* at point 101 so as to give the required time delay (19 seconds at 60 mph) depending on the distance between crossings. All these components are plugged into a plug-in board 100 shown in FIG. 7.

It is to be observed that the solar battery or similar unit can be used with lead acid or nickel cadmium 12 volt battery systems and consists of 36 solar cells series wired on a glass epoxy board encapsulated in silicone UV stabilized rubber for mechanical and environmental protection output (per NASA AMI 28° C) voltage 14.9 (includes voltage drop across the protective diode which is built into the panel). The current is 1.5 amps., wattage 25, size 2 feet × 2 feet × $1\frac{5}{8}$ inches.

Figure 1:
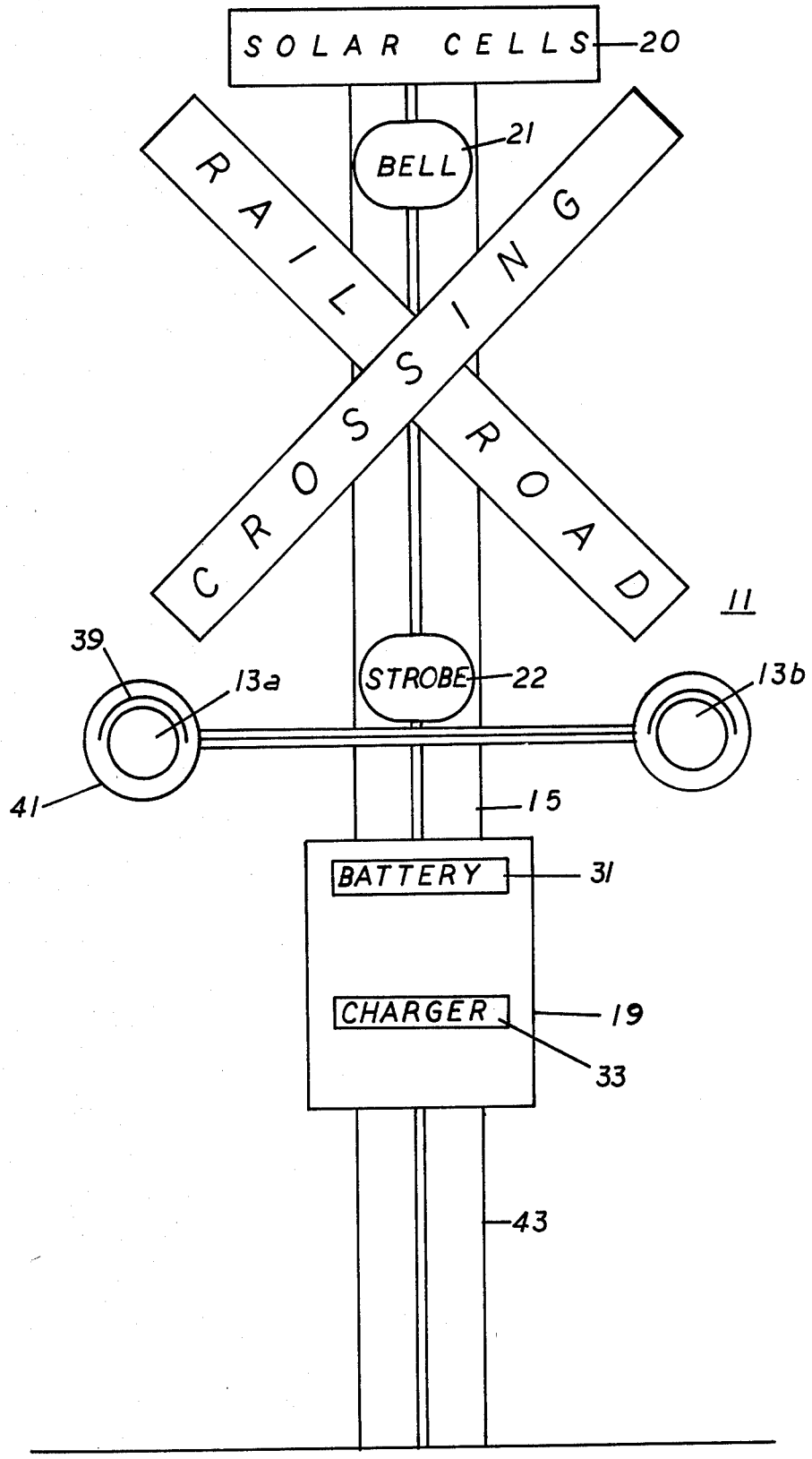
FIG. 1 shows a front view of the device contemplated herein.
Figure 2:
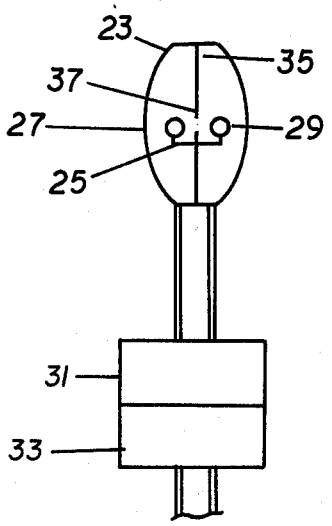
FIG. 2 is a side view of the device of FIG. 1.

This solar charger can be purchased commercially since it is already on the market and can be used to keep the battery fully charged in large regions of the United States, by utilizing the solar circuit herein since this circuit requires so little power source. It is optional and can be used where commercial power is not easily available, and also would eliminate the cost of metered power. This could prove less costly over an extended period. As shown in FIG. 1, it is possible to install the unit on top of an existing post and simply connect the (plus) cable to a regular battery (plus) terminal and the (minus) cable to the battery (minus) terminal.

I claim:

1. A railroad crossing signal device comprising:

a. a T-shaped structure (15) with arm ends and lamp housing means at said ends, a center pole with a circuit housing, a battery charger and a battery compartment (19) thereat;

b. first and second bulb holders (25) in said lamp housing means, a shield (35) between said bulb holders, and an aperture (37) in said shield so that if one bulb is extinguished the remaining bulb will still provide a signal;

c. pairs of pig-tail lines leading from said circuit housing for connection to rails including a pair of lead and a pair of lag lines;

d. a filter circuit (45) including a battery coupling connected to said pig-tail lines;

e. a logic circuit (47) coupled to said filter circuit (45) including logic means to ascertain the presence and direction of a train in the lead and lag directions, said logic circuit having output side (73); and, f. a timer circuit coupled between said logic circuit and said bulbs including an enabling relay, said timer circuit providing a blinking signal to said bulbs.

2. A device as claimed in claim 1 including a bank of solar cells above the T-shaped structure, electrically coupled to said battery compartment (19).

3. A device as claimed in claim 1 for use near two or more crossings including variable delay timer (81*a*) coupled to said filter circuit.

* * * * *